US006558072B2

(12) United States Patent
Staffenhagen et al.

(10) Patent No.: US 6,558,072 B2
(45) Date of Patent: May 6, 2003

(54) SPEED CONTROL SYSTEM FOR A WORK MACHINE

(75) Inventors: Greg B. Staffenhagen, Champlin, MN (US); Tom J. Suelflow, Maplewood, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 09/858,128

(22) Filed: May 15, 2001

(65) Prior Publication Data

US 2002/0172556 A1 Nov. 21, 2002

(51) Int. Cl.[7] ..... E01C 19/28
(52) U.S. Cl. ..... 404/117; 701/50
(58) Field of Search ..... 404/113, 117; 701/50; 702/142–148; 700/151

(56) References Cited

U.S. PATENT DOCUMENTS

| | | | | |
|---|---|---|---|---|
| 3,599,543 A | * | 8/1971 | Kerridge | 404/117 |
| 4,149,253 A | | 4/1979 | Paar et al. | |
| 4,330,738 A | * | 5/1982 | Paramythioti et al. | 318/128 |
| 4,870,601 A | | 9/1989 | Sandstrom | |
| 5,177,415 A | | 1/1993 | Quibel et al. | |
| 5,695,298 A | | 12/1997 | Sandstrom | |
| 5,719,338 A | | 2/1998 | Magalski et al. | |
| 5,727,900 A | | 3/1998 | Sandstrom | |
| 5,781,874 A | | 7/1998 | Troppman et al. | |
| 5,797,699 A | | 8/1998 | Blancke et al. | |
| 5,934,824 A | | 8/1999 | Vural | |
| 5,942,679 A | | 8/1999 | Sandstrom | |
| 6,055,486 A | | 4/2000 | Minnich et al. | |
| 6,065,904 A | | 5/2000 | Cook et al. | |

* cited by examiner

*Primary Examiner*—Heather Shackelford
*Assistant Examiner*—Sunil Singh
(74) *Attorney, Agent, or Firm*—Jeff A. Greene

(57) ABSTRACT

A work machine 10 for increasing the density of a compactable material 12 includes at least one compacting drum 14 driven by a two-speed drive arrangement 40. Compacting drum 14 also includes a vibratory mechanism 26 that is powered by a hydraulic motor 28. A first input device 54 is used to select the frequency of the vibratory mechanism 26. A second input device is used to select the output speed of the two-speed drive arrangement 40. A third input device 66 is used to select a desired impact spacing of the vibratory mechanism relative to the output speed of the two-speed drive arrangement 40. A controller 52 receives signals from the input devices 54,60,66 and responsively controls the output of a pump 22 automatically propelling the work machine 10 to a speed at which the desired impact spacing is obtained.

13 Claims, 2 Drawing Sheets

SPEED CONTROL SYSTEM FOR A WORK MACHINE

TECHNICAL FIELD

The invention relates to a speed control system for a work machine and more specifically to a speed control system for a compaction work machine that allows the operator to easily set a desired impact spacing

BACKGROUND

Large compacting work machines include rotatable drums with internal eccentric weights/vibratory mechanisms that are rotated to impose impact forces on a compactable surface being traversed, such as soil, roadway base aggregate, or asphalt paving material. The operator, to achieve maximum compactive effort and production efficiency for a given compacting operation, controls three functional settings of the compacting work machine. These settings are the frequency of the impact forces (# of impacts per unit of time e.g. vibrations per minute), propel speed of the compacting work machine (distance traveled per unit of time e.g. meters per minute), and impact spacing (# of impacts per distance traveled e.g. vibrations per meter).

Factors that influence the control of the three variables are experience of the operator and the simplicity or effectiveness of machine control systems. Different methods and machine control systems have been utilized to optimize the relationship of these three variables. One such system is disclosed in U.S. Pat. No. 5,719,338 issued Feb. 8, 1998 to Edward Magalski and assigned to Ingersoll-Rand Company. This system uses sensors to measure the rotational speed of the hydraulic motors used to propel the machine and to rotate the vibratory mechanisms. A signal is sent to a controller that compares the signal from the sensors and creates a signal indicative of the impact spacing. During a compacting operation the impact spacing signal is displayed on a gage. While effective this system makes the operator monitor the gage and control propel speed to ensure that the proper impact spacing is maintained all while steering the compacting work machine. Thus, causing the operator to monitor and control multiple functions of the compacting work machine simultaneously.

The present invention is directed to overcoming one or more of the problems as set forth above.

SUMMARY OF THE INVENTION

In one aspect of the present invention a speed control system for a work machine is provided. The speed control system includes a first input device that is adapted to produce a first signal indicative of a desired rotational speed of a fluid motor. A second input device is adapted to produce a second signal indicative of a desired propel speed. A third input device is adapted to produce a third signal indicative of a desired impact spacing. A controller receives the first signal, the second signal and the third signal, compares the first and second signals to the third signal and responsively produces an output signal.

In another aspect of the present invention a method for controlling the speed of a compaction work machine is provided. The method includes the steps of selecting a frequency setting from a first input device adapted to produce a first signal indicative of a desired rotational speed of a fluid motor. Then, selecting a propel speed from a second input device adapted to produce a second signal indicative of a desired propel speed. Next, selecting a desired impact spacing from a third input device adapted to produce a third signal indicative of a desired impact spacing. Then, comparing the frequency setting and the propel speed setting with the impact spacing setting. Lastly, responsively producing an output signal.

DETAILED DESCRIPTION

Figure 1:
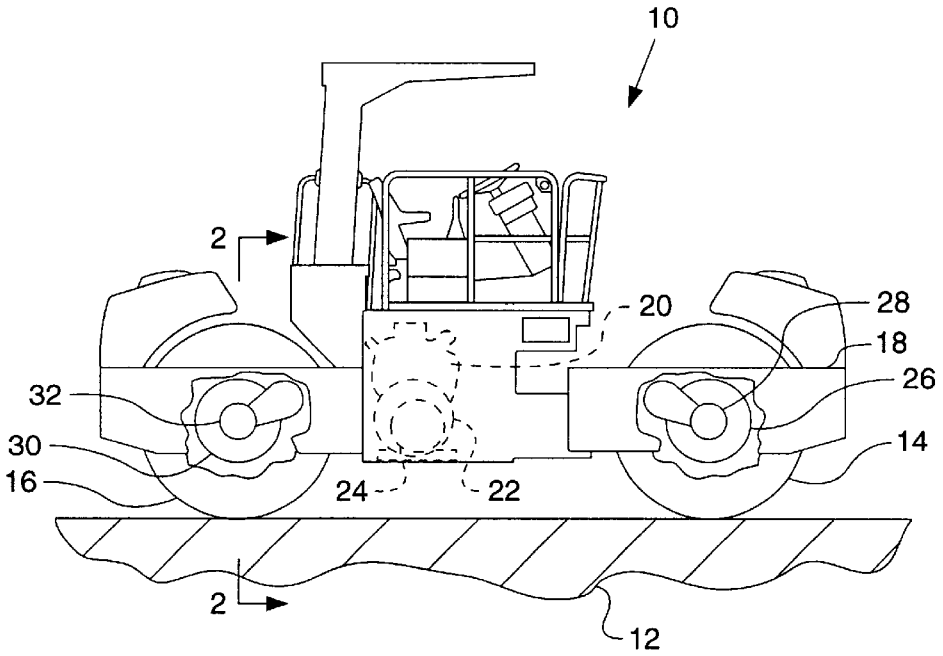
FIG. 1 is a side elevational view of a compacting work machine embodying the present invention.
Figure 2:
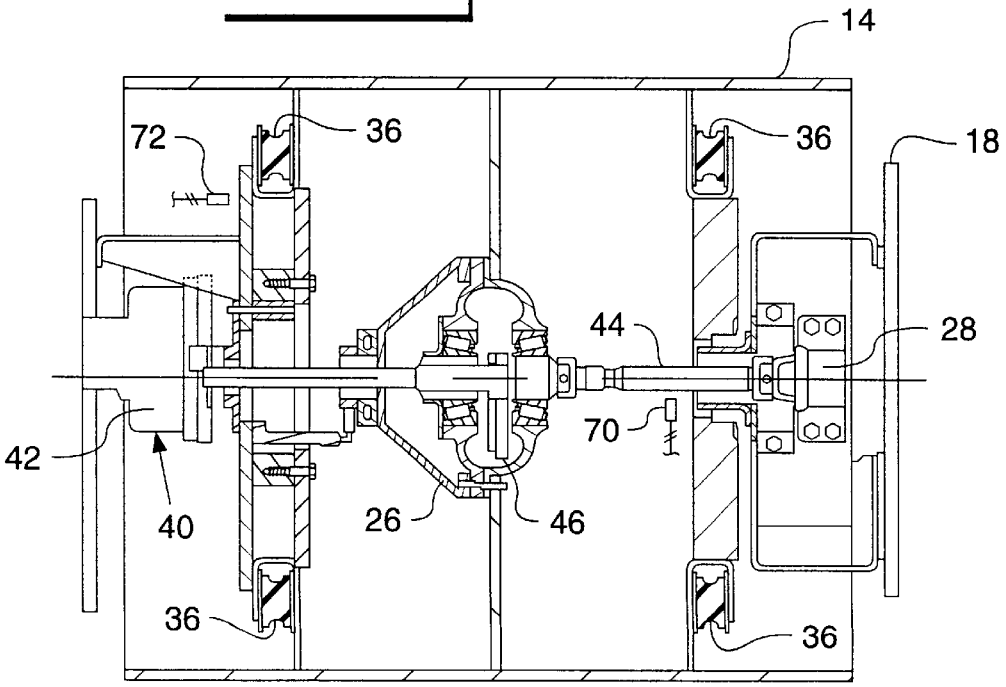
FIG. 2 is an enlarged cut away view of a single vibratory drum.

Referring to FIGS. 1 and 2, a work machine 10 for increasing the density of a compactable material 12 such as soil, roadway base aggregate, or asphalt paving material is shown. The work machine 10 is for example, a double drum vibratory compactor, having a first compacting drum 14 and a second compacting drum 16 rotatably mounted on a main frame 18. The main frame 18 also supports an engine 20 that has first and second fluid pumps 22,24 operatively and conventionally connected thereto.

The first compacting drum 14 includes a first vibratory mechanism 26 that is operatively connected to a first hydraulic motor 28. The second compacting drum 16 includes a second vibratory mechanism 30 that is operatively connected to a second hydraulic motor 32. It should be understood that the first and second compacting drums 14,16 might have more than one vibratory mechanism per drum without departing from the spirit of the present invention.

In as much as the first compacting drum 14 and the second compacting drum 16 are structurally and operatively similar the description, construction and elements comprising the first compacting drum 14, as shown in FIG. 2, equally applies to the second compacting drum 16. Therefore, no further discussion will be made to the second compacting drum 16.

Referring now to FIG. 2, rubber mounts 36 vibrationally isolate compacting drum 14 from the main frame 18. The compacting drum 14 includes a two-speed drive arrangement 40. The two-speed drive arrangement 40 is a fluid propel motor 42 with a planetary reduction unit, not shown, that is operatively connected by hoses or conduits, not shown, to the pump 22. The fluid motor 42 is connected to the main frame 18 and operatively connected to the first compacting drum 14. Pump 22 supplies a pressurized operation fluid, such as oil to the fluid motor 42 for propelling the work machine 10.

Pump 24 is operatively connected to the first hydraulic motor 28 by hoses or conduits, not shown. A shaft 44 connects the first vibratory mechanism 26 to the first hydraulic motor 28. The first vibratory mechanism 26 includes an eccentric mass 46 that is powered by the first hydraulic motor 28 thereby imparting a vibratory force on the compacting drum 14. It should also be noted that pump 24 is selectable between a high output and a low output for rotating the eccentric mass 46 at high frequency and low frequency.

Figure 3:
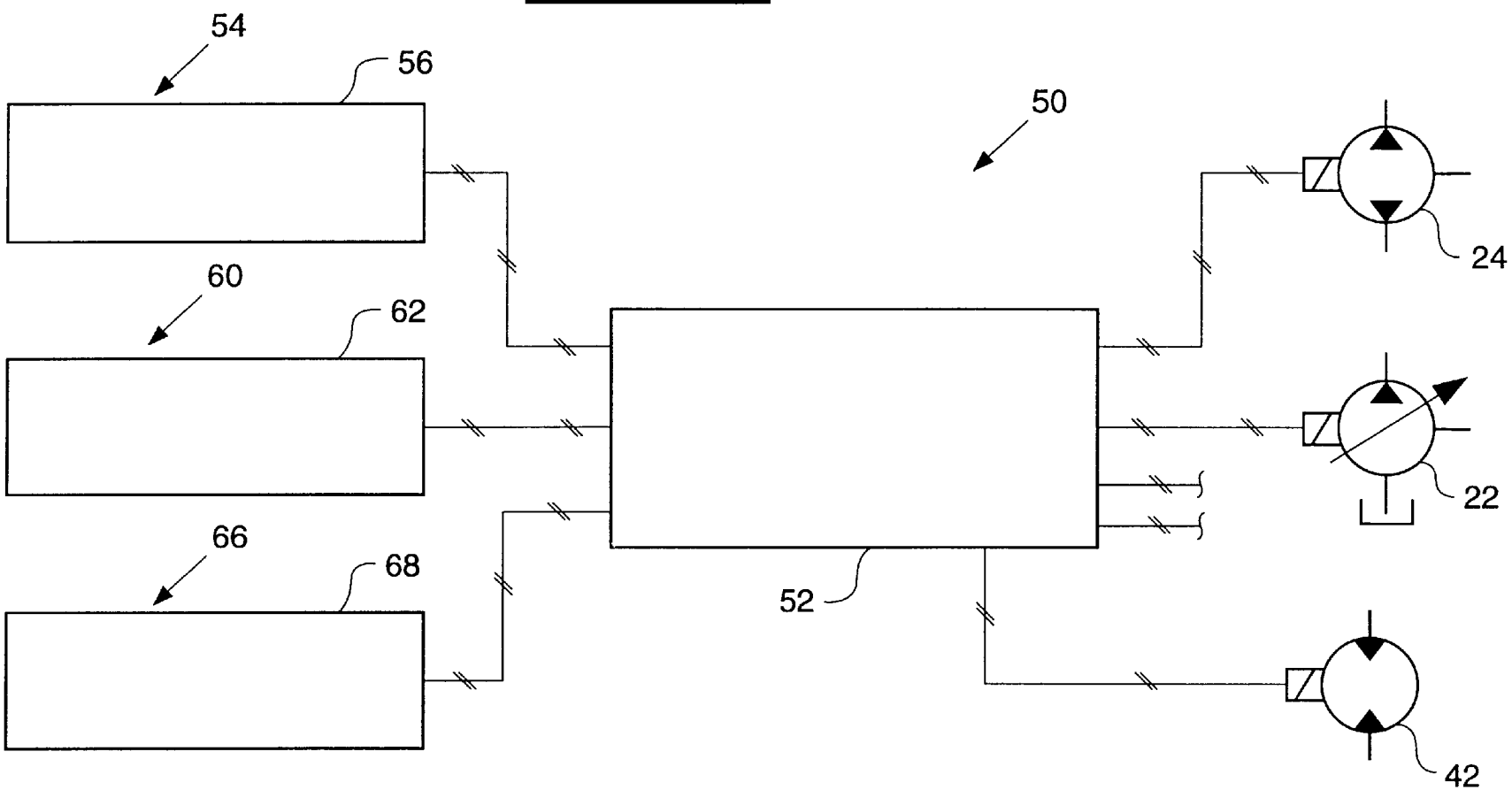
FIG. 3 is a block diagram of a speed control system for the compacting work machine in FIG. 1.

With reference to FIG. 3, a speed control system 50 is shown for the work machine 10. The speed control system 50 includes a controller 52 that is operatively connected to the first and second fluid pumps 22,24 in a known manner.

A first input device 54 is connected to the controller 52 as by wire. The first input device 54 is a frequency selector switch 56 that is selectable between high and low frequency (vibrations per minute) settings to operate the second fluid pump 24 at the desired output level. The frequency selector switch 56 can be a toggle switch, a touch screen input or any of a number of known input devices.

A second input device 60 is connected to the controller 52 as by wire. The second input device 60 is a propel speed selector switch 62 that is operatively connected with the two-speed drive arrangement 40. The propel speed selector switch 62 controls the output of fluid motor 42 for selecting changing between high and low propel speeds (meters per minute). The propel speed selector switch 62, as well, can be a toggle switch, a touch screen input or any of a number of known input devices.

A third input device 66 is additionally connected to the controller 52 as by wire. The third input device 66 is an impact spacing selector switch 68 used to input a desired impact spacing setting (impacts per meter). The impact spacing selector switch 68 is an infinitely variable input device such as a potentiometer, a touch screen input or any of a number of known infinitely variable input devices.

Alternatively, as shown in FIGS. 2 and 3, speed sensors 70,72 can also be connected to the controller 52. Speed sensors 70,72 are positioned to measure the output speed of fluid motor 28 and fluid motor 42 respectively.

Speed sensors 70,72 provide a feedback loop to the controller 52 in a typical manner.

INDUSTRIAL APPLICABILITY

In operation the speed control system 50 functions in the following manner. The operator selects a frequency setting from the first input device 54. A first electrical signal is sent to the controller 52 indicative of the desired rotational speed or output of fluid motor 28. The first electrical signal controls the rotational speed of vibratory mechanism 26 or the frequency. The operator then selects a propel speed setting from the second input device 60. A second electrical signal is sent to the controller 52 indicative of the desired output speed of fluid motor 42. The second electrical signal controls the output of the two-speed drive arrangement 40 and propel speed of the work machine 10. The operators next step is to select an impact spacing setting from the third input device 66. A third electrical signal is sent to the controller 52 indicative of the desired impact spacing.

The controller 52 compares the first and second electrical signals to the third signal and responsively generates an output signal. When the operator inputs a propel command from either a joystick or hydrostatic lever (not shown) the output signal, from the controller 52, commands an appropriate output from the fluid propel pump 22. Thus, automatically controlling the propel speed of the work machine 10 based on the impact spacing setting of the impact spacing selector switch 68. This leaves the operator free to steer the work machine 10 without monitoring and controlling any other machine operations.

What is claimed is:

1. A speed control system for a work machine comprising:

a first input device adapted to produce a first signal indicative of a desired rotational speed of a fluid motor;

a second input device adapted to produce a second signal indicative of a desired propel speed;

a third input device adapted to produce a third signal indicative of a desired impact spacing; and a controller adapted to receive the first signal, the second signal and the third signal, compare the first and second signals to the third signal and responsively produce an output signal.

2. The speed control system of claim 1, wherein the fluid motor drives a vibratory mechanism.

3. The speed control system of claim 1, wherein the first input device is selectable between two frequency settings.

4. The speed control system of claim 1, wherein the desired impact spacing is infinitely variable.

5. The speed control system of claim 1, wherein the desired propel speed is controlled by a two-speed drive arrangement.

6. The speed control system of claim 5, wherein the two-speed drive arrangement is powered by a variable displacement pump.

7. The speed control system of claim 6, wherein the output signal controls the variable displacement pump.

8. The speed control system of claim 1, including:

a first speed sensor adapted to provide a first feedback signal indicative of the rotational speed of the fluid motor;

a second speed sensor adapted to provide a second feedback signal indicative of the propel speed; and wherein said first and second speed sensors provide a feedback loop to the controller.

9. The speed control system of claim 1, wherein the output signal controls the displacement of a hydraulic pump.

10. A speed control system for a compaction work machine comprising:

a frequency input device adapted to produce a frequency signal indicative of a desired rotational speed of a vibratory mechanism;

a propel speed input device adapted to produce a propel speed signal indicative of a two speed drive arrangement;

an impact spacing input device adapted to produce an impact spacing signal indicative of a desired impact spacing; and a controller adapted to receive the frequency signal, the propel speed signal and the impact spacing signal, compare the frequency and propel speed signals to the impact spacing signal and responsively produce and output signal.

11. The speed control system of claim 10, wherein the frequency input device is selectable between two frequency settings.

12. The speed control system of claim 10, wherein the two speed drive arrangement includes a two speed fluid motor and a planetary gear mechanism.

13. A method for controlling the speed of a compaction work machine comprising the steps of:

selecting a frequency setting from a first input device adapted to produce a first signal indicative of a desired rotational speed of a fluid motor;

selecting a propel speed from a second input device adapted to produce a second signal indicative of a desired propel speed;

selecting a desired impact spacing from a third input device adapted to produce a third signal indicative of a desired impact spacing; and comparing the frequency setting and the propel speed setting with the impact spacing setting; and responsively producing an out put signal.

* * * * *